US010862235B1

(12) United States Patent
Yue

(10) Patent No.: US 10,862,235 B1
(45) Date of Patent: Dec. 8, 2020

(54) MINI-SCALE COAXIAL CONNECTOR

(71) Applicant: AMPHENOL EAST ASIA ELECTRONIC TECHNOLOGY (SHEN ZHEN) CO., LTD., Shen Zhen (CN)

(72) Inventor: Yu Yue, Shen Zhen (CN)

(73) Assignee: AMPHENOL EAST ASIA ELECTRONIC TECHNOLOGY (SHEN ZHEN) CO., LTD., Shen Zhen (CN)

( * ) Notice: Subject to any disclaimer, the term of this patent is extended or adjusted under 35 U.S.C. 154(b) by 0 days.

(21) Appl. No.: 16/801,974

(22) Filed: Feb. 26, 2020

(51) Int. Cl.

| | |
|---|---|
| ***H01R 12/88*** | (2011.01) |
| ***H01R 12/59*** | (2011.01) |
| ***H01R 13/42*** | (2006.01) |
| ***H01R 12/72*** | (2011.01) |

(52) U.S. Cl.
CPC ..... *H01R 12/88* (2013.01); *H01R 12/592* (2013.01); *H01R 12/598* (2013.01); *H01R 12/721* (2013.01); *H01R 13/42* (2013.01)

(58) Field of Classification Search
CPC ..... H01R 12/88
See application file for complete search history.

(56) References Cited

U.S. PATENT DOCUMENTS

| | | | | |
|---|---|---|---|---|
| 4,172,626 | A * | 10/1979 | Olsson | H01R 13/193 439/329 |
| 4,534,608 | A * | 8/1985 | Scott | H01R 12/775 439/345 |
| 2013/0237098 | A1* | 9/2013 | Inomae | H01R 12/79 439/635 |
| 2014/0322941 | A1* | 10/2014 | Lee | H01R 12/88 439/153 |
| 2018/0191094 | A1* | 7/2018 | Wang | H01R 12/88 |
| 2019/0199025 | A1* | 6/2019 | Kim | H01R 12/79 |
| 2019/0334289 | A1* | 10/2019 | Uchida | H01R 13/40 |

* cited by examiner

*Primary Examiner* — James Harvey
(74) *Attorney, Agent, or Firm* — Muncy, Geissler, Olds & Lowe, P.C.

(57) ABSTRACT

A mini-scale coaxial connector includes a board end connector fixed on a PCB, and a cable end connector, with an overall thickness not over 0.8 mm; the board end connector including a frame member, a cramp ring, and an attachment member; the cable end connector connected with a cable and including a casing member and a mask member; the frame member including an engagement ring groove and a locking protrusion; the engagement ring groove disposed on the frame member; the locking protrusion disposed on two lateral sides of the frame member; the cramp ring formed in a semi-circular shape, with two ends thereof passing through the frame member with an axle; the cramp ring rotating about the axle; the cramp ring including an engagement position; the attachment member disposed on the cramp ring; the mask member and the casing member combined, with a cable terminal engaged therebetween.

4 Claims, 2 Drawing Sheets

MINI-SCALE COAXIAL CONNECTOR

BACKGROUND OF THE INVENTION

1. Field of the Invention

The present invention relates to coaxial connectors, and more particularly, to a mini-scale coaxial connector.

2. Description of the Related Art

A coaxial connector is widely applied in the technical fields of communication, storage, and transmission of consumer electronics. Also, with market development, a minimized coaxial connector becomes the trend of the consumer electronics industry, which requires the structural compactness, space saving, connection firmness, and convenience of plugging.

SUMMARY OF THE INVENTION

For improving the issues above, a mini-scale coaxial connector is provided. With the structural optimization, issues of structural looseness, inconvenience of plugging, and unstable connection in the prior arts are resolved.

For achieving the aforementioned objectives, a mini-scale coaxial connector is provided, comprising a board end connector and a cable end connector;

the board end connector being fixed on a printed circuit board (PCB) and combined with the cable end connector, with an overall thickness of the board end connector and the cable end connector not greater than 0.8 mm; the board end connector comprising a frame member, a cramp ring, and an attachment member;

the cable end connector being connected with a cable, the cable end connector comprising a casing member and a mask member;

the frame member comprising an engagement ring groove and a locking protrusion;

the engagement ring groove being disposed on an outer side of an edge of an engagement end of the frame member;

the locking protrusion being disposed on two lateral sides of the frame member;

the cramp ring being formed in a semi-circular shape, with two ends of the cramp ring passing through two sides of the frame member with a rotational axle; the cramp ring being configured to rotate about the rotational axle;

the cramp ring comprising an engagement position formed on the cramp ring;

the attachment member being disposed on the cramp ring;

the mask member and the casing member being combined, with a cable terminal engaged between the mask member and the casing member;

the casing member comprising an engagement protrusion;

the engagement protrusion being disposed on an outer side of an edge of an engagement end of the casing member; wherein when the board end connector is fixed on the printed circuit board and combined with the cable end connector, the engagement protrusion is inserted in the engagement ring groove; when the cramp ring rotates to a same plane with the frame member, the locking protrusion is engaged with the engagement position, and the attachment member is adhered to the frame member and engaged with the cable end connector.

Preferably, the frame member of the mini-scale coaxial connector in accordance with an embodiment of the present invention comprises a fixing bolt; the fixing bolt is disposed on a connection face between the frame member and the printed circuit board; the frame member is inserted into the printed circuit board through the fixing bolt, so as to be fixed on the printed circuit board.

Preferably, an interval distance of the cable terminal in the mini-scale coaxial connector in accordance with an embodiment of the present invention is not greater than 0.5 mm.

Preferably, the frame member in the mini-scale coaxial connector in accordance with an embodiment of the present invention is formed by metal injection molding.

With such configuration, issues of structural looseness, inconvenience of plugging, and unstable connection in the prior arts are resolved. The present invention achieves following novel features. With the overall thickness of the board end connector and the cable end connector not greater than 0.8 mm, the final product of the present invention is thinned down. With the interval distance of the cable terminal being not greater than 0.5 mm, the area occupation of the final PCB product is lowered. The amount of the terminals are allowed to be adjusted according to user demand. The cable end connector is applied for fixing the cable end, such that the cable end is directly combined with the PCB, lowering the loss of signal transmission and simplifying the structures. The frame member of the board end connector is formed by metal injection molding, so as to replace the plastic material for improving the structural strength and facilitating the welding usage thereof.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Figure 1:
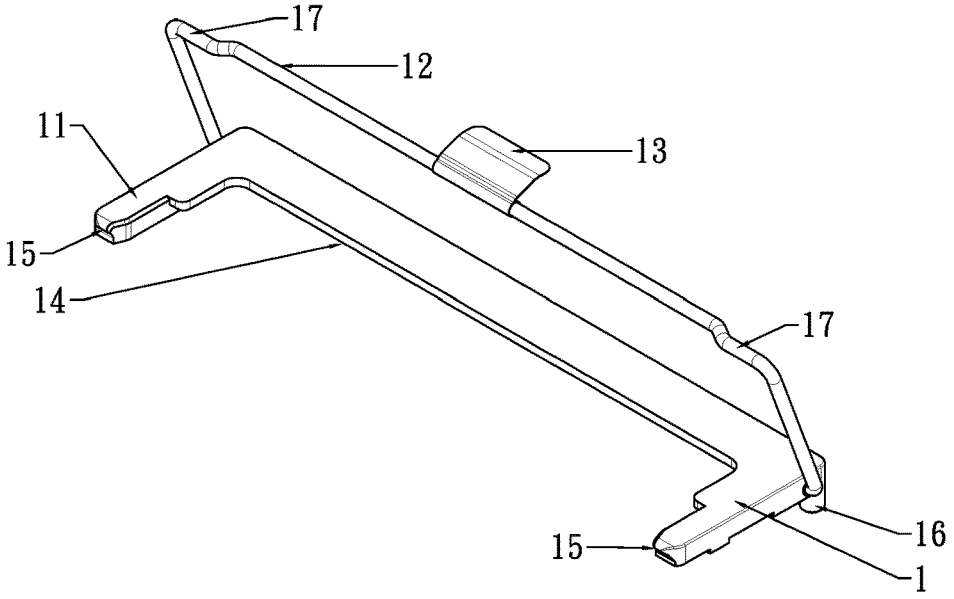
FIG. 1 is a perspective view of the board end connector of the mini-scale coaxial connector in accordance with an embodiment of the present invention.
Figure 2:
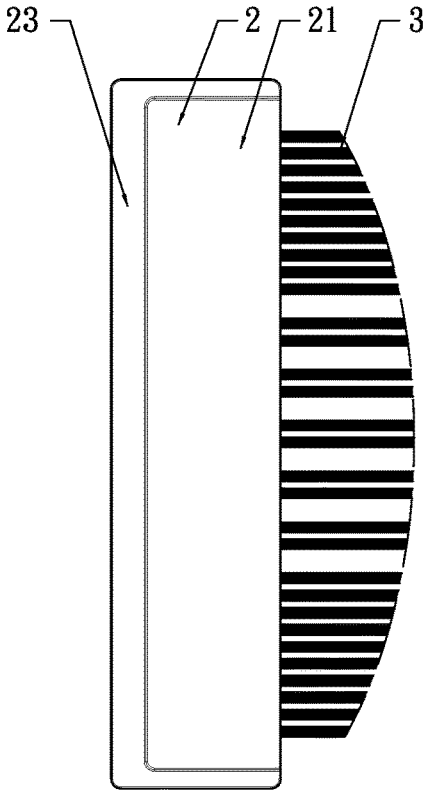
FIG. 2 is a top view of the cable end connector of the mini-scale coaxial connector in accordance with an embodiment of the present invention.
Figure 3:
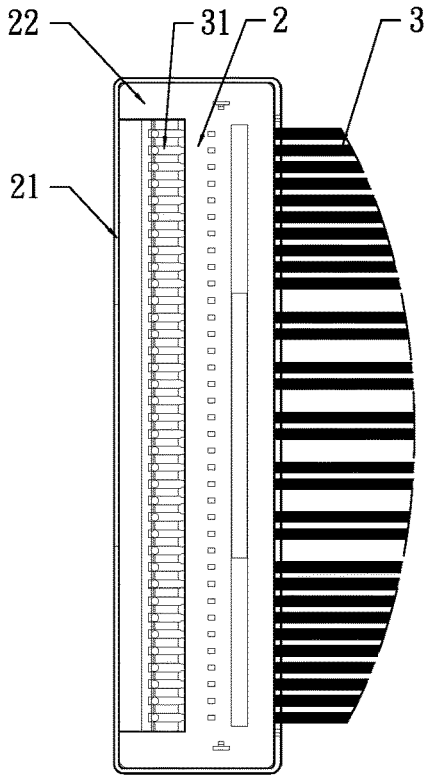
FIG. 3 is a bottom view of the cable end connector of the mini-scale coaxial connector in accordance with an embodiment of the present invention.
Figure 4:
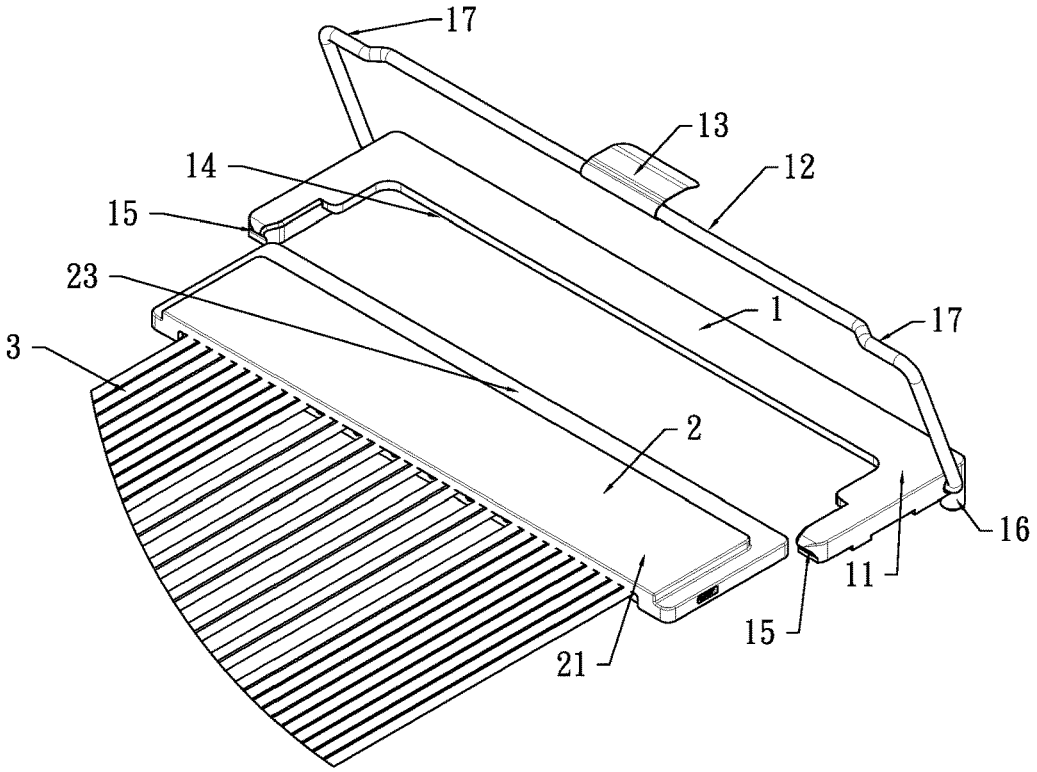
FIG. 4 is a schematic view illustrating the board end connector and the cable end connector of the mini-scale coaxial connector in a combination status.

Referring to FIG. 1 to FIG. 4, a mini-scale coaxial connector in accordance with an embodiment of the present invention is provided, comprising a board end connector 1 and a cable end connector 2.

The board end connector 1 is fixed on a printed circuit board (PCB) and combined with the cable end connector 2, with an overall thickness of the board end connector 1 and the cable end connector 2 not greater than 0.8 mm. The board end connector 1 comprises a frame member 11, a cramp ring 12, and an attachment member 13.

The cable end connector 2 is connected with a cable 3, and the cable end connector 2 comprises a casing member 21 and a mask member 22.

The frame member 11 comprises an engagement ring groove 14, a locking protrusion 15, and a fixing bolt 16. The frame member 11 is formed through a metal injection molding.

The engagement ring groove 14 is disposed on an outer side of an edge of an engagement end of the frame member 11.

The locking protrusion 15 is disposed on two lateral sides of the frame member 11.

The cramp ring 12 is formed in a semi-circular shape, with two ends of the cramp ring 12 passing through two sides of the frame member 11 with a rotational axle. The cramp ring 12 is configured to rotate about the rotational axle.

The cramp ring 12 comprises an engagement position 17 formed on an inner side of the semi-circular shape.

The attachment member 13 is disposed on the cramp ring 12.

The fixing bolt 16 is disposed on a connection face between the frame member 11 and the printed circuit board. The frame member 11 is inserted into the printed circuit board through the fixing bolt 16, so as to be fixed on the printed circuit board.

The mask member 22 and the casing member 21 are combined, with a cable terminal 31 engaged between the mask member 22 and the casing member 21. The interval distance of the cable terminal 31 is not greater than 0.5 mm.

The casing member 21 comprises an engagement protrusion 23.

The engagement protrusion 23 is disposed on an outer side of an edge of an engagement end of the casing member 21.

When the board end connector 1 is fixed on the printed circuit board and combined with the cable end connector 2, the engagement protrusion 23 is inserted in the engagement ring groove 14. When the cramp ring 12 rotates to a same plane with the frame member 11, the locking protrusion 15 is engaged with the engagement position 17, and the attachment member 13 is adhered to the frame member 11, so that the board end connector 1 is stably engaged with the cable end connector 2.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A mini-scale coaxial connector is provided, comprising:

a board end connector and a cable end connector;

the board end connector being fixed on a printed circuit board (PCB) and combined with the cable end connector, with an overall thickness of the board end connector and the cable end connector not greater than 0.8 mm; the board end connector comprising a frame member, a cramp ring, and an attachment member;

the cable end connector being connected with a cable, the cable end connector comprising a casing member and a mask member;

the frame member comprising an engagement ring groove and a locking protrusion;

the engagement ring groove being disposed on an outer side of an edge of an engagement end of the frame member;

the locking protrusion being disposed on two lateral sides of the frame member;

the cramp ring being formed in a semi-circular shape, with two ends of the cramp ring passing through two sides of the frame member by use of a rotational axle; the cramp ring being configured to rotate about the rotational axle;

the cramp ring comprising an engagement position formed on an inner side of the cramp ring;

the attachment member being disposed on the cramp ring;

the mask member and the casing member being combined, with a cable terminal engaged between the mask member and the casing member;

the casing member comprising an engagement protrusion;

the engagement protrusion being disposed on an outer side of an edge of an engagement end of the casing member; wherein when the board end connector is fixed on the printed circuit board and combined with the cable end connector, the engagement protrusion is inserted in the engagement ring groove; when the cramp ring rotates to a same plane with the frame member, the locking protrusion is engaged with the engagement position, and the attachment member is adhered to the frame member and engaged with the cable end connector.

2. The mini-scale coaxial connector of claim 1, wherein the frame member comprises a fixing bolt; the fixing bolt is disposed on a connection face between the frame member and the printed circuit board; the frame member is inserted into the printed circuit board through the fixing bolt, so as to be fixed on the printed circuit board.

3. The mini-scale coaxial connector of claim 1, wherein an interval distance of the cable terminal is not greater than 0.5 mm.

4. The mini-scale coaxial connector of claim 1, wherein the frame member is formed by metal injection molding.

* * * * *